US005313013A

United States Patent [19]

Suzuki et al.

[11] Patent Number: 5,313,013

[45] Date of Patent: May 17, 1994

[54] TONE SIGNAL SYNTHESIZER WITH TOUCH CONTROL

[75] Inventors: Norio Suzuki; Takaaki Muto, both of Hamamatsu, Japan

[73] Assignee: Yamaha Corporation, Hamamatsu, Japan

[21] Appl. No.: 738,218

[22] Filed: Jul. 30, 1991

[30] Foreign Application Priority Data

Aug. 8, 1990 [JP] Japan ..... 2-208266

[51] Int. Cl.[5] ..... G10H 7/00

[52] U.S. Cl. ..... 84/622; 84/624; 84/661; 84/DIG. 9; 84/DIG. 1

[58] Field of Search ..... 84/622-625, 84/659-661, DIG. 9, DIG. 10, DIG. 26

[56] References Cited

U.S. PATENT DOCUMENTS

| | | | |
|---|---|---|---|
| 4,419,897 | 12/1983 | Matsuoka | 73/660 |
| 4,703,680 | 11/1987 | Wachi et al. | 84/DIG. 2 |
| 4,731,835 | 3/1988 | Futamase et al. | 381/63 |
| 4,907,484 | 3/1990 | Suzuki et al. | 84/661 |
| 4,932,303 | 6/1990 | Kimpara | 84/621 |
| 4,960,030 | 10/1990 | Fujimori | 84/609 |
| 4,998,457 | 3/1991 | Suzuki et al. | 84/600 |
| 5,010,801 | 4/1991 | Sakashita | 84/735 |
| 5,036,541 | 7/1991 | Kato | 381/62 |
| 5,117,729 | 6/1992 | Kunimoto | 84/660 |

FOREIGN PATENT DOCUMENTS

| | | |
|---|---|---|
| 0248527 | 12/1987 | European Pat. Off. . |
| 0410465A1 | 7/1990 | European Pat. Off. . |
| 6491192 | 12/1983 | Japan . |

*Primary Examiner*—William M. Shoop, Jr.
*Assistant Examiner*—Brian Sircus
*Attorney, Agent, or Firm*—Graham & James

[57] ABSTRACT

A loop circuit including a delay element and an all-pass filter circulates a tone signal. A driving waveform is applied to the loop circuit. The delay element provides a delay time corresponding to the pitch of the circulating tone signal and the all-pass filter is capable of changing the phase of the tone signal corresponding to its frequency. Thus, the resulting musical tone can be controlled in accordance with touch, thereby enabling the simulation of vibration of pitch and the generation of non-harmonic components caused by touch in a natural musical instrument.

13 Claims, 13 Drawing Sheets

TONE SIGNAL SYNTHESIZER WITH TOUCH CONTROL

BACKGROUND OF THE INVENTION a) Field of the Invention

The present invention relates to a tone signal synthesizer using a delayed feedback type tone signal synthesizing algorithm for synthesizing a tone signal by waveform processing through inputting a driving waveform signal into a closed loop containing a delay means and a filter means and circulating the driving waveform signal in the closed loop. In particular, it relates to a tone signal synthesizer adapted for an electronic musical instrument capable of providing tone control to simulate musical tones of natural musical instruments.

b) Description of the Prior Art

In a waveform read type tone signal synthesizer, tone signals different in pitch are synthesized by reading a fundamental waveform (for example, a sinusoidal waveform) at different reading speed. Because the number of points sampled from the fundamental waveform decreases as the frequency increases, the characteristics of the synthesized tone signals deteriorate. Further, it is difficult to change the signal waveform with the passage of time.

Japanese Patent Postexam. Publication No. Sho-58-58679 has proposed a technique for synthesizing a tone signal by inputting a driving waveform signal into a closed loop formed by a serial connection of a filter and a delay circuit and repeatedly circulating the driving waveform signal in the closed loop. According to this technique, the amplitude, high-frequency content, high-frequency phase, etc. of the signal can be changed widely with the passage of time, so that musical tones more perfectly approaching the musical tones of natural musical instruments can be generated compared with the waveform read type tone signal synthesizer.

In recent electronic musical instruments, a technique for changing various characteristics by touch has been popularized. For example, the attack-decay-sustain-release waveform of a musical tone in a natural musical instrument can be simulated by controlling a sound volume envelope correspondingly to the touch. Further, the vibration of pitch caused by the touch can be simulated.

In natural musical instruments such as a piano, not only a sound volume changes in accordance with touch but the pitch and harmonic structure of a musical tone change just after key depression and then return to the designated pitch and the standard harmonic structure with the passage of time. With respect to the harmonic structure, the musical tone just after key depression contains many non-harmonic pitch components as well as harmonics having pitches expressed by integers or simple fractional numbers with respect to the pitch of a fundamental tone. The non-harmonic pitch components decrease with the passage of time, so that a pure harmonic structure remains.

SUMMARY OF THE INVENTION

An object of the present invention is to provide a tone signal synthesizer using a delayed feedback type tone synthesizing algorithm by which a musical tone can be controlled in accordance with touch.

Another object of the present invention is to provide a tone signal synthesizer by which various characteristics can be changed in accordance with touch to simulate the vibration of pitch and the generation of non-harmonic components caused by touch in a natural musical instrument.

According to an aspect of the present invention, there is provided a tone signal synthesizer comprises a loop circuit for circulating a tone signal, means for applying a driving waveform to the loop circuit, a delay circuit connected within the loop circuit, for giving delay time corresponding to pitch to the circulating tone signal, and a variable all-pass filter connected within the loop circuit and being capable of changing the phase of the tone signal corresponding to the frequency thereof.

DESCRIPTION OF THE PREFERRED EMBODIMENTS

To facilitate understanding of the present invention, first, a delayed feedback type tone signal synthesizer will be described.

Figure 4:
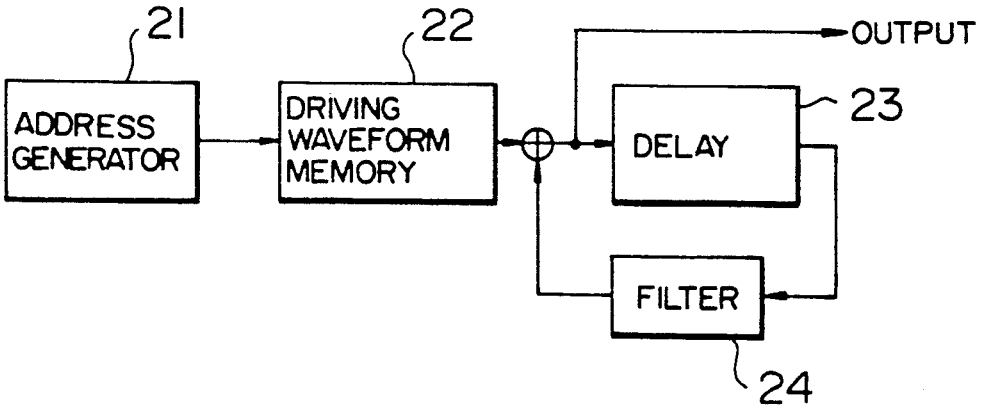
FIG. 4 PRIOR ART
FIG. 4 is a block diagram showing an example of the configuration of a conventional tone generator circuit.

FIG. 4 shows a tone generator circuit (tone signal synthesizer) like that disclosed in the above Japanese Patent Postexam. Publication No. Sho-58-58679. In the drawing, an address generator 21 generates an address signal according to a tone generation command, or the like, given from an CPU (not shown), or the like. A driving waveform memory 22 generates a driving waveform signal on the basis of the address signal and supplies the driving waveform signal into a closed loop constituted by a delay circuit 23 and a filter 24. The driving waveform signal circulates in the closed loop. The delay circuit 23 determines the time required for one circulation, that is, the pitch of a tone signal to be generated. The low-pass filter 24 gives such a decay characteristic in which the decay rate becomes high as the pitch becomes high. The tone signal can be picked up at a desired point in the closed loop.

Embodiments of the present invention will be described hereunder with reference to the drawings.

Figure 1:
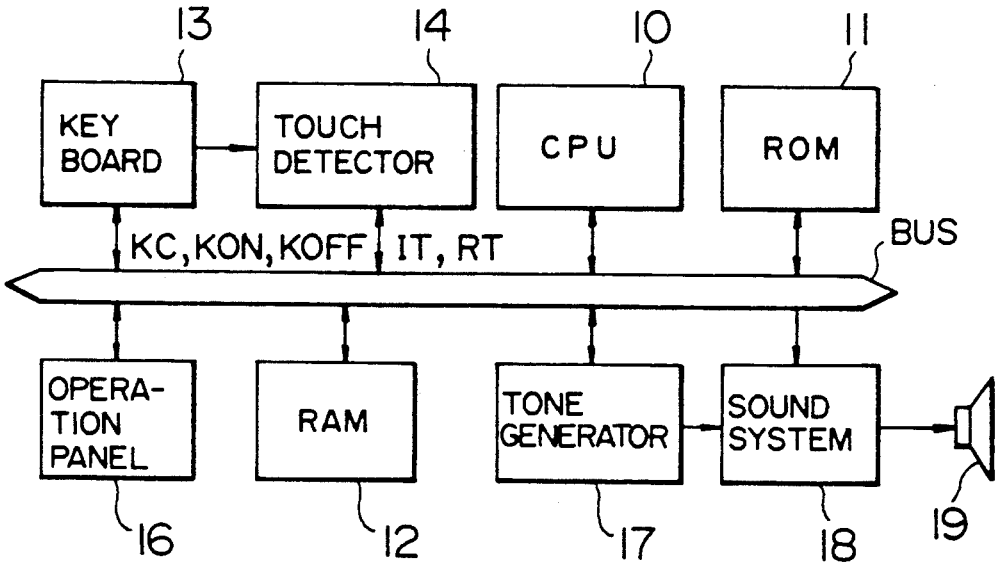
FIG. 1 is a block diagram showing the outline of an electronic musical instrument according to an embodiment of the present invention.

FIG. 1 is a block diagram showing the outline of an electronic keyboard instrument according to an embodiment of the present invention.

In the electronic keyboard instrument, the operation thereof is generally controlled by a central processing unit (CPU) 10. A read-only memory (ROM) 11, a random access memory (RAM) 12, a keyboard circuit 13, a touch information detection circuit 14, an operation panel 16 and a tone generator circuit 17 are connected to the CPU 10 through a two-directional bus line BUS. A sound system 18 is connected to the tone generator circuit 17. A speaker 19 is connected to the sound system 18.

In FIG. 1, programs for controlling the CPU 10 and data necessary for generating various kinds of musical tones are stored in the ROM 11.

The RAM 12 is used as a temporary storage or register necessary for generating various kinds of musical tones.

The keyboard circuit 13 has a keyboard capable of touch detection. The keyboard circuit 13 detects the operation of a key on the keyboard and generates a key code representing the operated key, a key-on signal (KON) representing the state of key depression and a key-off signal (KOFF) representing the state of key release.

The touch information detection circuit 14 detects the key depression speed or key release speed of the key operated on the keyboard and generates initial touch information IT representing the key depression speed and release touch information RT representing the key release speed.

The operation panel 16 is provided for switching tone color and for setting other parameters necessary for the electronic musical instrument.

The tone generator circuit 17 synthesizes a musical tone signal on the basis of parameters given from the CPU 10.

The sound system 18 converts digital data outputted from the tone generator circuit 17 into analogue data for actuating the speaker 19, and, if necessary, amplifies the analogue data.

Figure 2:
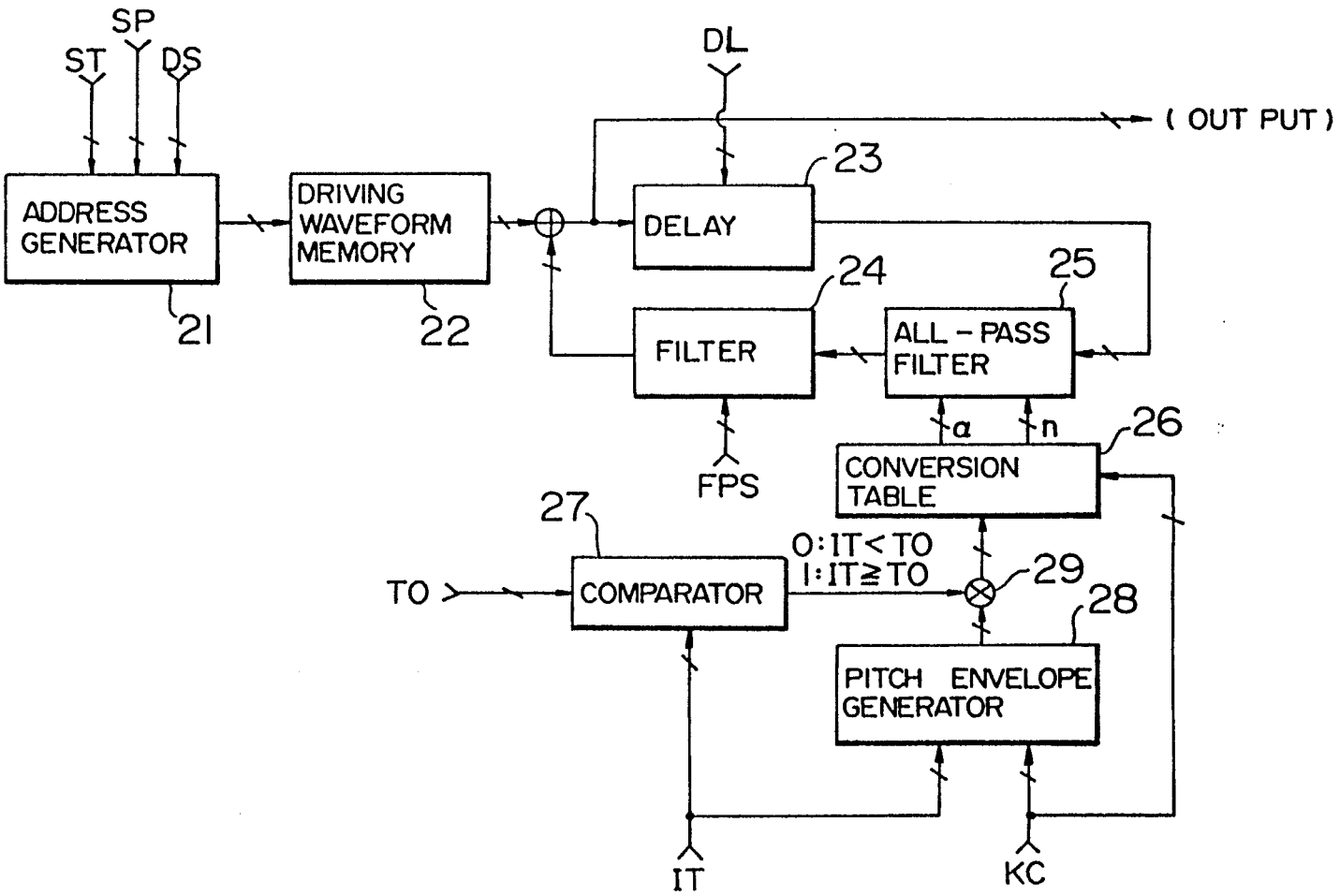
FIG. 2 is a block diagram showing an example of the configuration of the tone generator circuit depicted in FIG. 1.

FIG. 2 shows the configuration of the tone generator circuit 17 depicted in FIG. 1. The tone generator circuit 17 changes the filter factor in accordance with touch. The circuit of FIG. 2 is the same as the circuit shown in FIG. 4 in that a driving waveform is read from a driving waveform memory 22 on the basis of an address signal generated by an address signal 21 and is supplied to a loop circuit. In the loop circuit, an all-pass filter 25 is connected in series to a filter 24. A filter factor generation circuit for giving a filter factor is connected to the all-pass filter 25.

The delay circuit 23, the low-pass filter 24 and the all-pass filter 25 constitute a feedback loop. The total delay amount of the delayed feedback loop corresponds to the pitch of the musical tone to be outputted. A conversion table 26, a comparator 27 and a pitch envelope generator 28 constitute a filter factor generation circuit.

The all-pass filter 25 is a filter having such a flat amplitude characteristic in which only the phase depends on the frequency in a predetermined use band. When a signal having a certain frequency circulates in the loop, the phase difference between the original signal and the output signal depends on the delay characteristic of the loop, that is, depends on the frequency characteristic of the all-pass filter.

The operation of the circuit in FIG. 2 will be described hereunder. The address generator 21 receives information such as a memory read starting signal ST, a memory read starting point and a read data size DS from the CPU 10 shown in FIG. 1 and generates address information for reading the waveform signal from the driving waveform memory 22 on the basis of the information.

The driving waveform memory 22 outputs a driving waveform addressed by the address information and supplies the driving waveform into the loop circuit including the delay circuit 23, the filter 24 and the all-pass filter 25.

The delay circuit 23 is a circuit for delaying an input by a predetermined time. The delay circuit 23 may be constituted by a shift register, an RAM, or the like. DL represents the number of delay stages in the delay circuit 23 generated in a conversion circuit 30 on the basis of the key code KC representing pitch. In the case where the delay circuit 23 is constituted by a shift register, DL represents the number of stages in the shift register.

The filter 24 is a filter having the same decay as that of the filter 24 used in the tone generator in FIG. 4. To give strong decay for high pitch, the filter 24 generally constituted by a low-pass filter may be used in combination with a band-pass filter, or the like, for attaining a specific tone color. That is, the filter 24 is used for attaining both the frequency characteristic and the decay characteristic of the output tone. The cut-off frequency, the decay rate, or the like, as the filter parameter FPS, are given to the filter 24 by the CPU 10. Alternatively, in the case where an ordinary digital filter difficult to process as analogue data, such as FIR or IIR, is used, a set of filter factors are given as the filter parameter FPS.

The all-pass filter 25 is substantially different from the filter 24 in that the filter 25 has no decay and gives delay time depending on the frequency. The all-pass filter 25 is similar to the delay circuit in that it gives delay time, but the filter 25 is different from the delay circuit in that it can give frequency dependency to the delay time.

A filter factor generation circuit constituted by a conversion table 26, a comparator 27 and a pitch envelope generator 28 is provided for setting both a filter factor $\alpha$ for controlling frequency dependency and a filter factor n for designating delay time independent of the frequency.

To determine the filter factor $\alpha$, the initial touch information IT supplied from the CPU 10 is compared with threshold information TO in the comparator 27. In the case of a piano, an output "1" is generated only when initial touch is not weaker than a predetermined threshold, in accordance with the fact that a change of pitch occurs when key touch is not weaker than a certain value. The threshold information TO may be given by a performer through the operation panel 16 or may be preset in the ROM 11 corresponding to the tone color. When a change of pitch caused by touch is to be avoided, the threshold information TO may be set at the maximum on the operation panel 16 so that an output signal "0" is always generated because IT is always smaller than TO in the case where the threshold information TO is to be set on the operation panel 16. Alternatively, in the case where the threshold information TO is preset in the ROM 11, a switch may be provided separately so that the comparator can be disabled when the change of pitch is to be avoided.

The pitch envelope generator 28 outputs a pitch envelope curve corresponding to the initial touch IT and the key code KC. To meet with the phenomenon that the change of pitch becomes larger as the touch becomes stronger in the performance of a natural musical instrument, the pitch envelope curve is provided which depends on the initial touch IT. Because the pitch envelope must be changed rapidly in high pitch region in which decay is generally rapid, the pitch envelope curve is provided which depends on the key code KC, that is, key scaling is made.

A multiplier 29 following the pitch envelope generator 28 multiplies the output of the pitch envelope generator 28 by the output ("0" or "1") of the comparator 27 so that a signal for giving the change of pitch to the filter 25 can be supplied to the conversion table when the initial touch IT is not weaker than the threshold TO. That is, when the output of the comparator 27 is "0", the output of the multiplier 29 becomes "0" regardless of the output of the pitch envelope generator 28 so that there occurs no change of pitch. When the output of the comparator 27 is "1", the output of the pitch envelope generator 28 is directly used as the output of the multiplier 29 to be given to the conversion table 26.

The conversion table 26 is a table for converting the pitch envelope outputted from the pitch envelope generator 28 into the filter factor $\alpha$ of the all-pass filter 25 correspondingly to the real change of pitch. The conversion table 26 serves also as a table for converting the key code KC into the number n of delay stages as the other filter factor. The width of the pitch change is limited by the parameter n. The factors $\alpha$ and n given by the table 26 are fed to the filter 25.

Figure 3:
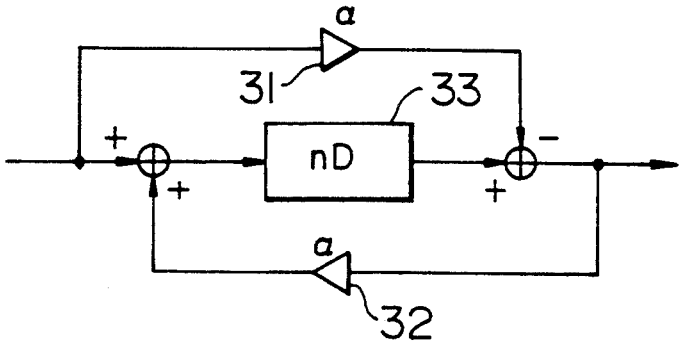
FIG. 3 is a block diagram showing an example of the configuration of the all-pass filter depicted in FIG. 2.

FIG. 3 shows an example of the configuration of a general first order all-pass filter. Adders 34 and 35 are connected respectively to the input side and the output side of a delay circuit 33. The output is fed back to the input-side adder 34 in phase through an amplifier 32 having an amplification factor $\alpha$. The input is fed forward to the output-side adder 35 in opposite phase through an amplifier having the amplification factor $\alpha$. The frequency characteristic of the phase change can be changed variously by changing the amplification factor $\alpha$ of the amplifiers 31 and 32. When, for example, the amplification factor $\alpha$ is zero, the all-pass filter is simply a delay circuit to give delay time equal for all frequencies. In general, in the all-pass filter having this structure, the phase difference depending on the frequency is widened as the amplification factor $\alpha$ approaches 1.

The number n of delay stages corresponding to the key code KC as the number of stages in the delay circuit (for example, a shift register) 33 and the factor $\alpha$ variable with the passage of time and outputted from the pitch envelope generator 28 (FIG. 2) corresponding to the key code KC and the initial touch IT as the amplification factor $\alpha$ of the amplifiers 31 and 32 are supplied from the conversion table 26 of FIG. 2 to the all-pass filter of FIG. 3. As a result, a musical tone in which pitch changes corresponding to the factors $\alpha$ and n is synthesized in the tone generator circuit 17 of FIG. 2.

As described above, in an electronic musical instrument as shown in FIG. 1, having a tone generator circuit as shown in FIG. 2, using an all-pass filter as shown in FIG. 3, a musical tone can be changed finely corresponding to the touch in the performance manipulation. In the following, important parts thereof are described more in detail in conjunction with modifications thereof.

Figure 5:
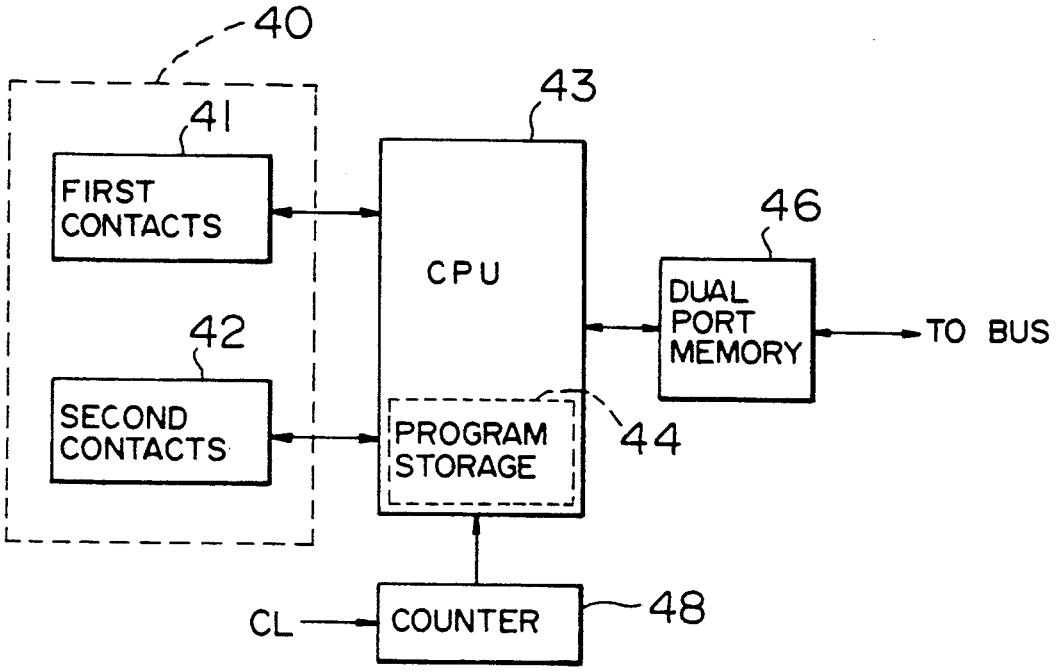
FIG. 5 is a block diagram showing an example of the configuration of a touch detection circuit in a keyboard instrument.

Means for detecting a touch signal is described now. FIG. 5 shows an example of a touch detection circuit in a keyboard instrument. A keyboard 40 has a large number of keys. A first contact and a second contact are provided in each of the keys. A group 41 of first contacts and a group 42 of second contacts are connected to a keyboard CPU 43. A counter 48 continuously counts a clock signal CL and supplies the count value to the CPU 43.

When the CPU 43 detects touch at the first contact of a certain key, the value of the running counter at the time of detection is stored. When the CPU 43 then detects touch at the second contact of the key, the value of the running counter at the time of detection is stored. The number of counts from the touch at the first contact to the touch at the second contact, that is, the time required from the touch at the first contact to the touch at the second contact, is detected by subtracting the value of the counter at the time of detection of the touch at the first contact from the value of the counter at the time of detection of the touch at the second contact. As the touch becomes stronger, the number of counts decreases. On the contrary, as the touch becomes weaker, the number of counts increases. The number of counts expressing the strength of the touch is converted into touch information by the CPU 43. The touch information is stored in a predetermined area of a dual port memory 46. These procedures are carried out according to a program stored in a program storage 44. The dual port memory 46 is also connected to the bus BUS. Data are exchanged between the CPU 10 of the musical instrument and the CPU 43 of the keyboard 40 through the memory.

Figure 6:
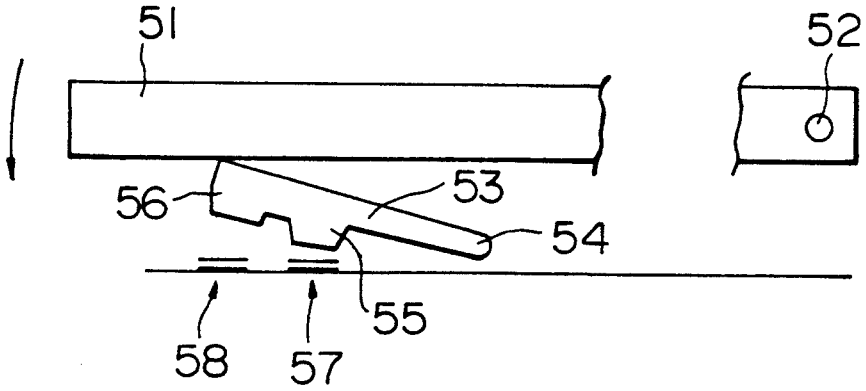
FIG. 6 is a schematic view showing an example of the structure of first and second contacts in the keyboard.

FIG. 6 schematically shows an example of structure of the first and second contacts in the keyboard. Each key 51 is supported by a fulcrum 52 so as to be rotatable. When the key 51 is pressed down, a hammer 53 supported by a fulcrum 54 so as to be rotatable is pressed down. Two projections 55 and 56 are provided in the lower surface of the hammer 53. At least those projections 55 and 56 are formed of elastic substance. When urged down, the hammer 53 touches the first contact 57 to make it and then touches the second contact 58 to make it. Such touches at the first and second contacts 57 and 58 are detected by the CPU shown in FIG. 5.

Figure 7A:
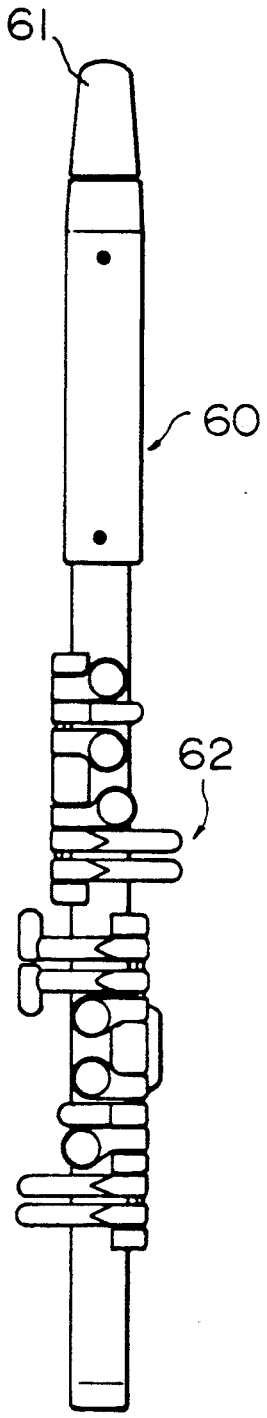
FIG. 7A is a schematic view showing the external appearance of a wind instrument type electronic musical instrument.

FIG. 7A shows the external appearance of a wind instrument type electronic musical instrument. A large number of keys 62 for designating pitches are provided in a main portion of a wind instrument body 60. A mouthpiece 61 is connected to one end of the body 60. A desired tone signal is generated by holding the mouthpiece in the mouth, giving breath into the mouthpiece 61 and manipulating the keys 62.

Figure 7B:
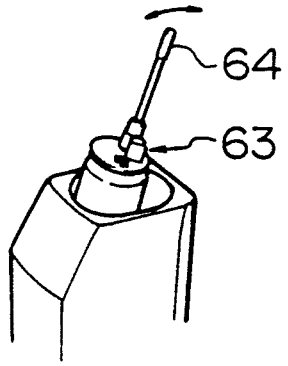
FIG. 7B is an enlarged partial perspective view showing the structure of the end portion of the wind instrument type electronic musical instrument.

FIG. 7B schematically shows a structure of the end portion of the wind instrument type electronic musical instrument 60 in the case where the mouthpiece 61 is detached. A pressure sensor 63 detects the pressure of breath of the performer. A cantilever 64 is formed so that the lever moves forth and back corresponding to the degree of closing of the performer's mouth to thereby give an output corresponding to the position of the lever. That is, the cantilever 64 detects the embouchure of the performer. The cantilever 64 being in contact with a lead of the wind instrument type manipulator detects the motion of the lead. The lead in the electronic musical instrument does not vibrate though the lead in a natural wind instrument vibrates. In short, the lead moves substantially merely corresponding to the state of the performer's mouth.

Figure 7C:
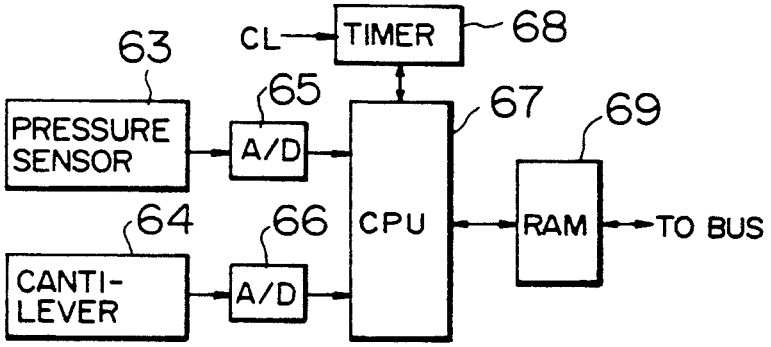
FIG. 7C is a block diagram showing a touch detection circuit adapted for the wind instrument type electronic musical instrument.

FIG. 7C shows a touch detection circuit adapted for the wind instrument type electronic musical instrument. The pressure sensor 63 and the cantilever 64 supply analogue signals corresponding to the pressure of breath and the embouchure to analog-to-digital converters 65 and 66, respectively. The analog-to-digital converters 65 and 66 convert input analogue signals into digital signals and supply the digital signals to a CPU 67. A timer 68 counts a clock signal CL and supplies the count value to the CPU 67. The CPU 67 detects the change of the pressure and the change of the embouchure in a period of a predetermined count value and forms a touch signal to be stored in a memory 69. The memory 69 is connected to the bus of the electronic musical instrument body to make data exchange between the memory 69 and the CPU of the electronic musical instrument body.

Figure 7D:
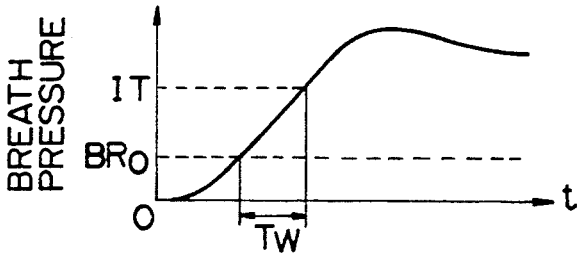
FIG. 7D is a graph for explaining the detection of an initial touch signal.

In the case of the wind instrument, the touch signal can be generated based on the breath pressure signal detected by the pressure sensor 63. FIG. 7D is a graph for explaining the detection of an initial touch signal IT.

The graph shows the case where the breath pressure rises gradually with the passage of time and then decreases slowly after reaching its maximum. The change of the breath pressure in a predetermined time Tw after exceeding a threshold level BR0 is detected. The passage of time Tw is detected by counting the count value supplied from the timer 68. The breath pressure IT after the passage of time Tw is detected as initial touch. The detection of such initial touch is made by interrupt processing at the time of detection of the breath pressure.

Figure 8A:
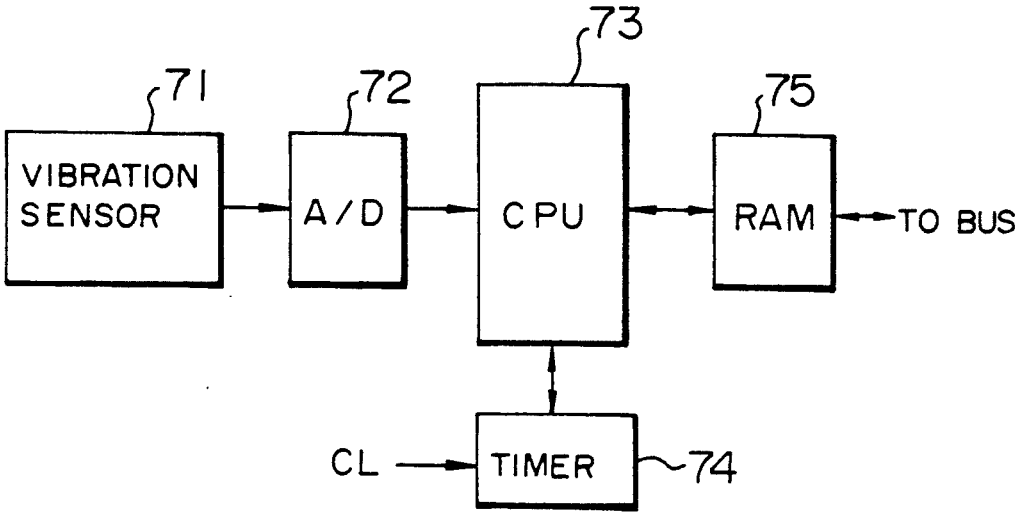
FIG. 8A is a block diagram showing an initial touch detection circuit in a percussion instrument type electronic musical instrument.
Figure 8B:
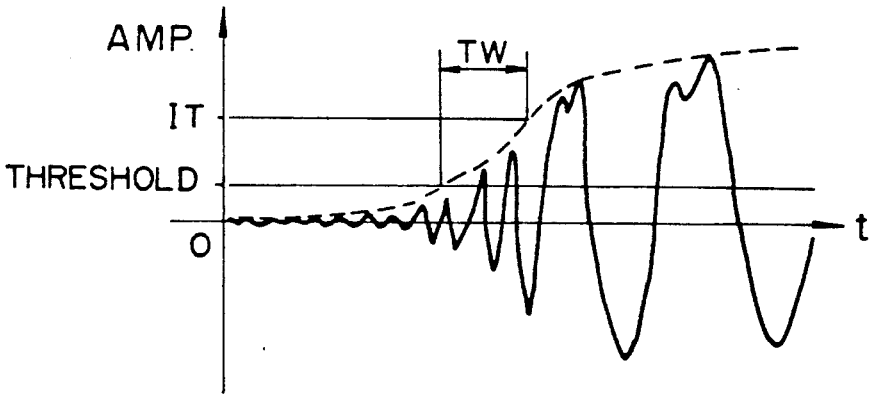
FIG. 8B is a graph for explaining the detection of initial touch.

FIGS. 8A and 8B show the detection of touch in the case of a percussion instrument.

FIG. 8A shows an initial touch detection circuit in a percussion instrument type electronic musical instrument. A vibration sensor 71 provided in a performance portion of the percussion instrument type electronic musical instrument detects vibration and supplies a detection signal to an analog-to-digital converter 72. The analog-to-digital converter 72 converts the signal into a digital signal and supplies the digital signal to a CPU 73. A timer 74 counts a clock signal and supplies a time signal to the CPU 73. The CPU 73 detects initial touch and makes an RAM 75 store initial touch information.

FIG. 8B is a graph for explaining the detection of initial touch. In the case of percussion instrument, the signal thus detected is a kind of alternating-current signal as shown in FIG. 8B. Because the detection signal is a kind of alternating-current signal, an envelope signal as shown by a broken line in FIG. 8B can be acquired by once subjecting the detection signal to a low-pass filter. A initial touch signal is detected by using the envelope signal in the same manner as described above with reference to FIG. 7D.

Although description is made upon the case of a percussion instrument, the aforementioned detection method can be also applied to a string instrument type electronic musical instrument in which vibration of a string is detected.

As described above, initial touch signals can be respectively detected from performance portions of electronic musical instruments having various performance styles. It is obvious to those skilled in the art that key code KC representing pitch and other tone forming parameters can be detected correspondingly to the form of the musical instrument.

Figure 9:
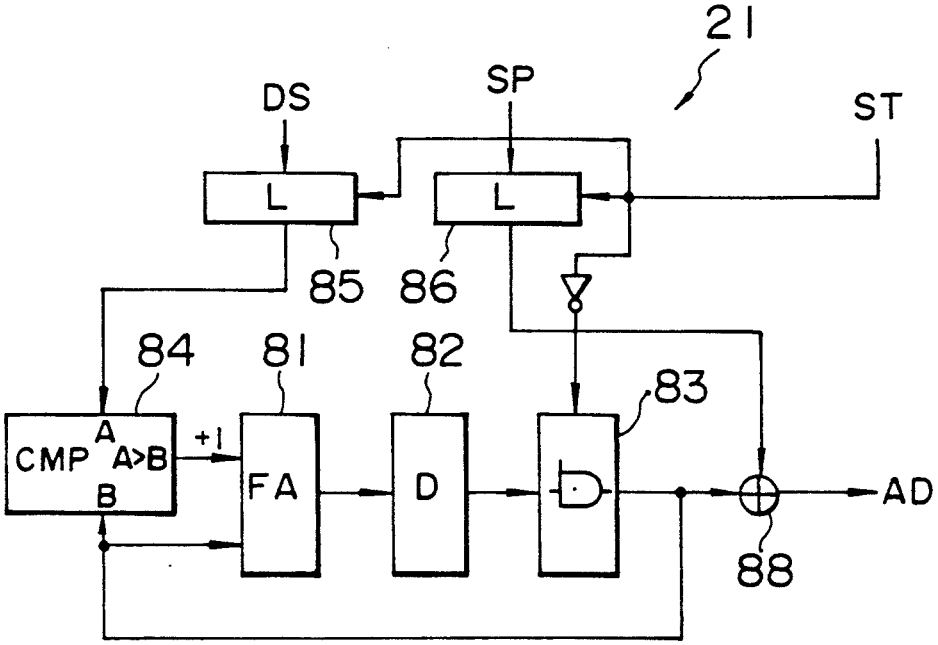
FIG. 9 is a block diagram showing an example of the configuration of the address generator.

In the following, main constituent members of the tone generator circuit shown in FIG. 2 are described. FIG. 9 shows an example of the configuration of the address generator 21. A full adder 81, a delay circuit 82 and an AND circuit group 83 are connected in series to constitute a loop circuit. A comparator 84 compares an input-A with an input-B and supplies "1" to the full adder 81 when the input-A is larger than the input-B. The input-A of the comparator 84 is connected to a latch circuit 85. The output of the loop circuit is fed out as an address signal through an adder 88. The output of a latch circuit 86 is applied to the adder 88. The latch circuits 85 and 86 latch the data size DS and the starting pointer SP, respectively.

When a starting pulse SP is given, the data in the loop circuit is reset by the AND circuit group 83. Thereafter, if the value in the loop is smaller than DS, the signal is increased by "1" in the full adder 81. When the value in the loop reaches DS, the output of the comparator 84 becomes zero so that the increment operation of the loop stops. The value in the loop is added to the starting pointer SP representing an address starting point by the adder 88 to thereby generate an address signal AD.

Figure 10A:
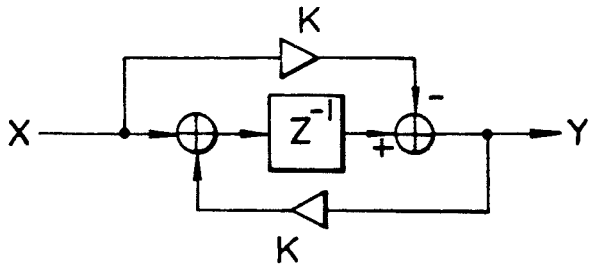
FIG. 10A is a diagram for explaining the function of the all-pass filter depicted in FIG. 3.

FIG. 10A is a diagram for explaining the function of the all-pass filter shown in FIG. 3. The input, the output, the amplification factor and the delay constant of the delay circuit are represented by X, Y, k and $Z^{-1}$, respectively.

When the respective values are represented as described above, the output Y can be expressed by the following equation.

$$Y=kYZ^{-1}+XZ^{-1}-kX$$

$$Y(1-kZ^{-1})=X(Z^{-1}-k)$$

$$Y/X=(Z^{-1}-k)/(1-kZ^{-1}).$$

Figure 10B:
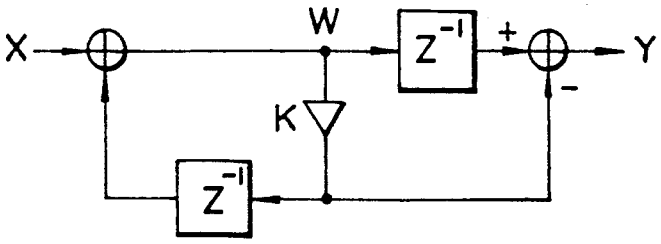
FIG. 10B is a diagram showing a circuit equivalent to the circuit of FIG. 10A.

FIG. 10B shows a circuit equivalent to the circuit of FIG. 10A and expressed by another circuit form.

The delay characteristic of a transfer function $$H(Z)=(Z^{-1}-k)/(1-kZ^{-1})$$

is expressed by the equation:

$$\tau(\omega X)=T(1-k2)/(1-3k\cos\omega T+k2)$$

in which $\omega$ represents the angular velocity, and $\tau(\omega X)$ represents the delay time for the angular velocity $\omega X$.

Figure 11:
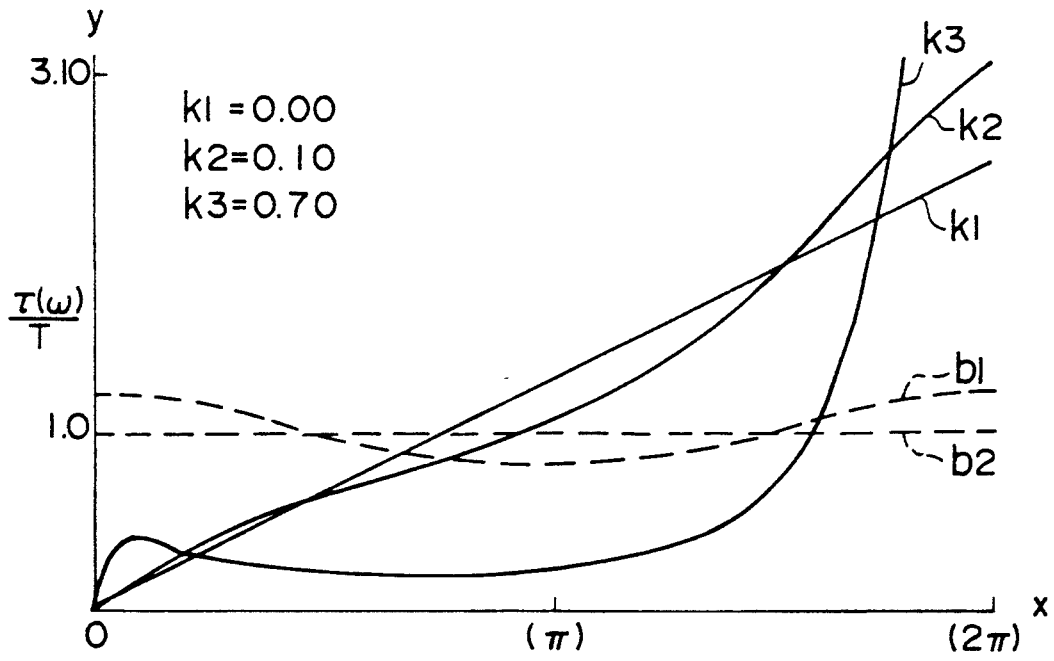
FIG. 11 is a graph showing the relationship between the sampling period and the change of $\phi T$.

FIG. 11 is a graph in which the ratio of the delay time to the sampling period T is plotted with respect to the change of $\omega T$. This relationship is the relationship between the phase angle and the frequency. When this relationship is rearranged to the relationship between the frequency and the delay amount, a curve as shown by a broken line is acquired.

It is obvious from FIG. 11 that the phase angle changes widely correspondingly to the frequency when the amplification factor $\alpha$ (k in the aforementioned equation) of the amplifiers 31 and 32 in the circuit of FIG. 3 is changed.

Figure 12:
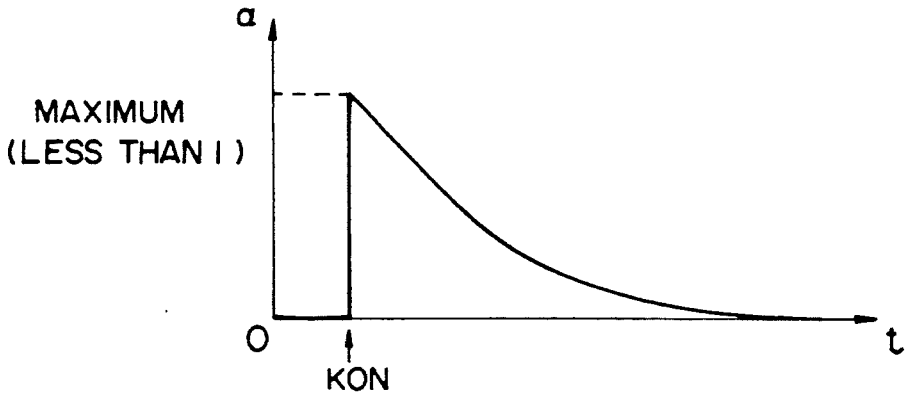
FIG. 12 is a graph showing the change of the amplification factor given to the all-pass filter, with the passage of time.

FIG. 12 is a graph showing an example of the change with the passage of time, of the amplification factor $\alpha$ given to the all-pass filter 25. The amplification factor $\alpha$ rises to a value near to 1 in response to the key on KON corresponding to key depression on the keyboard (or the like) and then decreases in the form of an exponential function. When $\alpha$ is near 1, many non-harmonic components are generated as is obvious from FIG. 11. The amplification factor $\alpha$ must be smaller than 1, because the all-pass filter becomes divergent for a direct current when $\alpha$ is 1.

Figure 13:
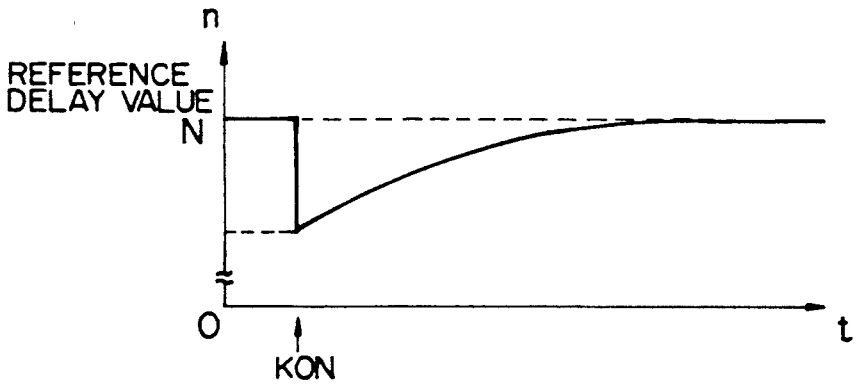
FIG. 13 is a graph showing the change of the number n of delay stages given to the all-pass filter, with the passage of time.

FIG. 13 is a graph showing the change with the passage of time, of the number n of delay stages given to the all-pass filter 25. The number n of delay stages decreases by a predetermined amount from a reference delay value N corresponding to the key on KON and then increases gradually to approach the original reference delay value N.

Figure 14:
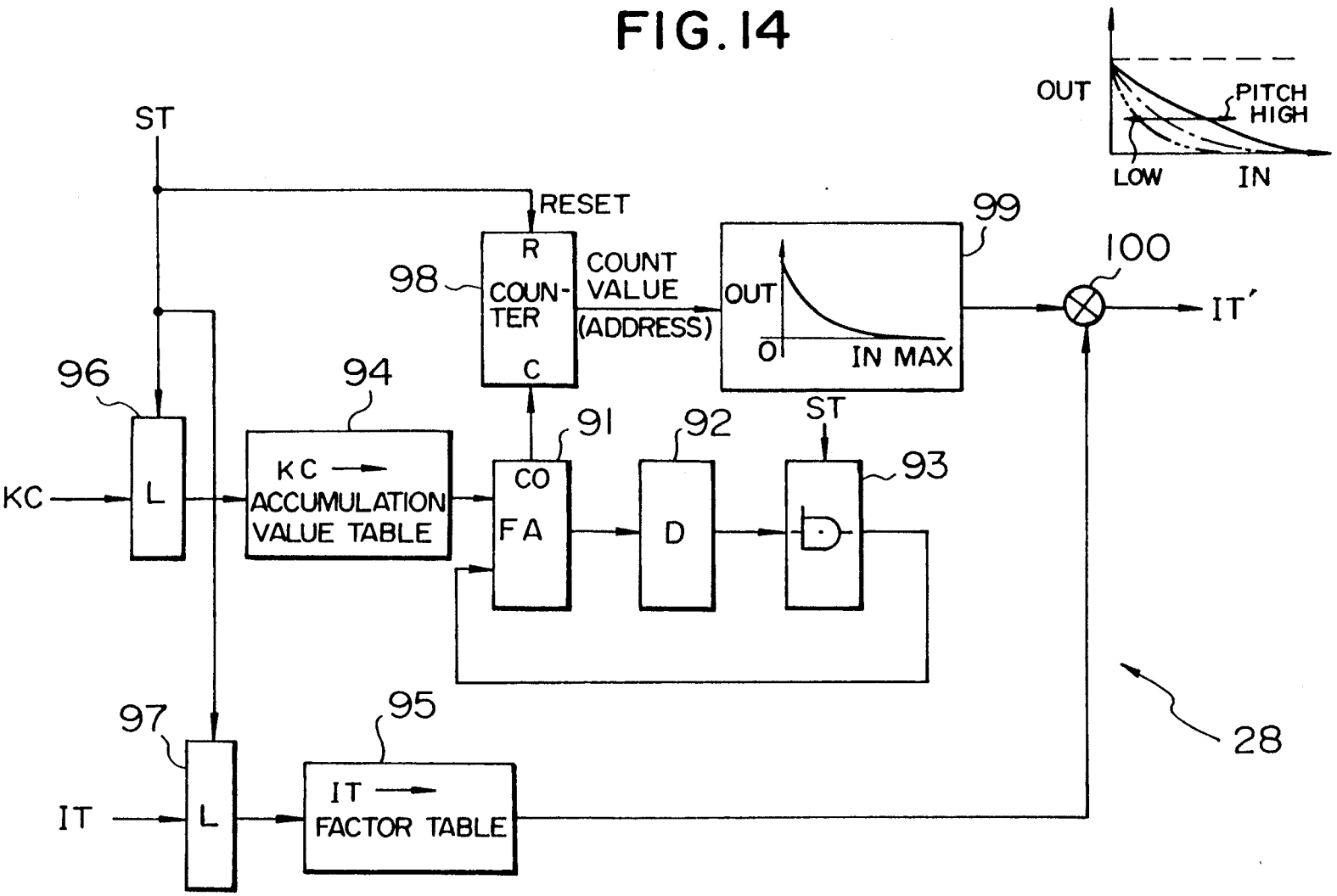
FIG. 14 is a block diagram showing the configuration of a memory type envelope generator.

In general, in a piano or the like, pitch rises at the time of string touch and then is gradually converged to a predetermined value. In order to realize this phenomenon by using the number of delay stages, it is necessary to reduce the number of delay stages at the time of key on KON and then converge the pitch to a predetermined value gradually. FIG. 14 shows the configuration of a memory type envelope generator 28.

A full adder 91, a delay circuit 92 and an AND circuit group 93 constitute a loop circuit which is the same as in FIG. 9. Latch circuits 96 and 97 latch key code KC information and initial touch IT information and supply them to a table 94 for deducing an accumulation value from the key code KC and a table 95 for deducing a factor from the initial touch IT, respectively. These latch circuits 96 and 97 are enabled by receiving a starting pulse ST. The starting pulse ST also serves to reset a counter 98. The counter 98 receives "carry out" from the full adder 91. A value corresponding to KC is accumulated by the loop to thereby generate a carry signal from the full adder 91 to thereby increase the value of the counter 98. When the value of the counter 98 reaches its maximum, the counting operation of the counter stops to keep the maximum value. As the key code KC becomes larger, a larger value is set to the table 94 for deducing an accumulation value from the key code KC. Accordingly, the envelope advances more rapidly as the pitch becomes higher. The count value of the counter 98 is used as an address of a memory 99, so that a signal having a waveform as shown in FIG. 14 is read from the memory 99. In a multiplier 100, the signal read from the memory 99 is multiplied by a factor supplied from the table 95, so that a pitch envelope IT' corresponding to the initial touch IT is generated. This pitch envelope IT' has such a characteristic as shown in the right side of FIG. 14, in which the pitch changes more widely as the input becomes larger. When the pitch envelope IT' is "0", the total pitch becomes equal to the pitch of the key code KC.

In the following, examples of configuration of the conversion table 26 shown in FIG. 2 are described.

Figure 15:
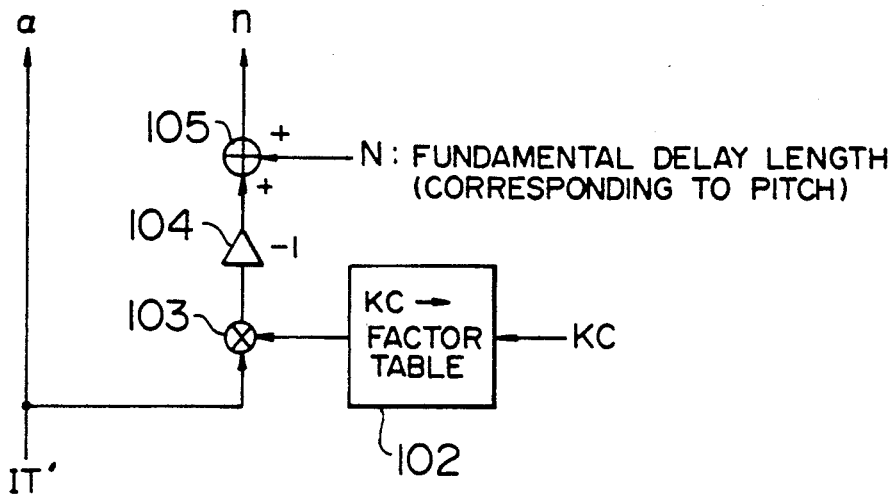
FIG. 15 is a diagram showing an example of the configuration of the conversion table using the envelope generator.

FIG. 15 shows an example of the configuration of the conversion table using the envelope generator in FIG. 14. With respect to the amplification factor $\alpha$, the pitch envelope IT' supplied can be used directly. With respect to the number n of delay stages, a procedure of subtraction from the fundamental delay length N is required. Because it is necessary to scale the range of the change of delay length corresponding to the key code KC, a factor corresponding to the key code is generated by using a table 102 for deducing a factor from the key code KC. This factor is multiplied by the pitch envelope in a multiplier 103, is inverted in an amplifier 104, and then is added to (or subtracted from) the fundamental delay length N. Thus, delay length n is generated.

Figure 16:
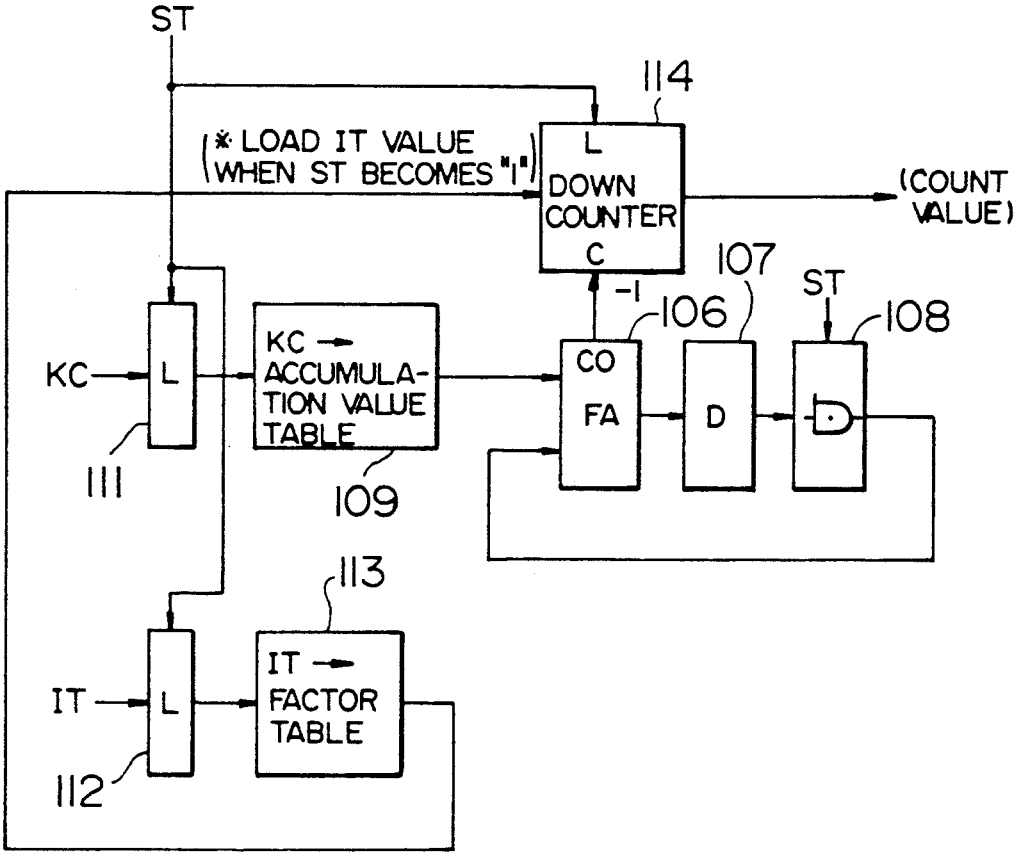
FIG. 16 is a block diagram showing an example of the configuration of a calculation type envelope generator.

FIG. 16 shows an example of the configuration of a calculation type envelope generator. A full adder 106, a delay circuit 107 and an AND circuit group 108 constitute a loop circuit. The output of a table 109 for deducing an accumulation value from the key code is applied to the full adder 106. The key code KC is supplied to the table 109 through a latch circuit 111. On the other hand, the initial touch IT is supplied to a table 113 for deducing a factor, through a latch circuit 112. The output of the table 113 is given to a down counter 114. The starting pulse ST is supplied to the latch circuits 111 and 112 and the down counter 114. When the starting pulse ST is "1", the down counter 114 loads the value of IT. Thereafter, the down counter 114 makes such a down counting operation whenever a carry rises from the full adder 106. A decreasing function having linear characteristic in a range of from a certain value to zero is acquired by: initially setting a value corresponding to the initial touch IT to the down counter; and decreasing the value of the down counter one by one in the timing corresponding to the key code KC. Here, the down counter is defined as a counter in which the counting operation thereof stops to keep the output of the counter zero when the value of the counter reaches zero.

Figure 17:
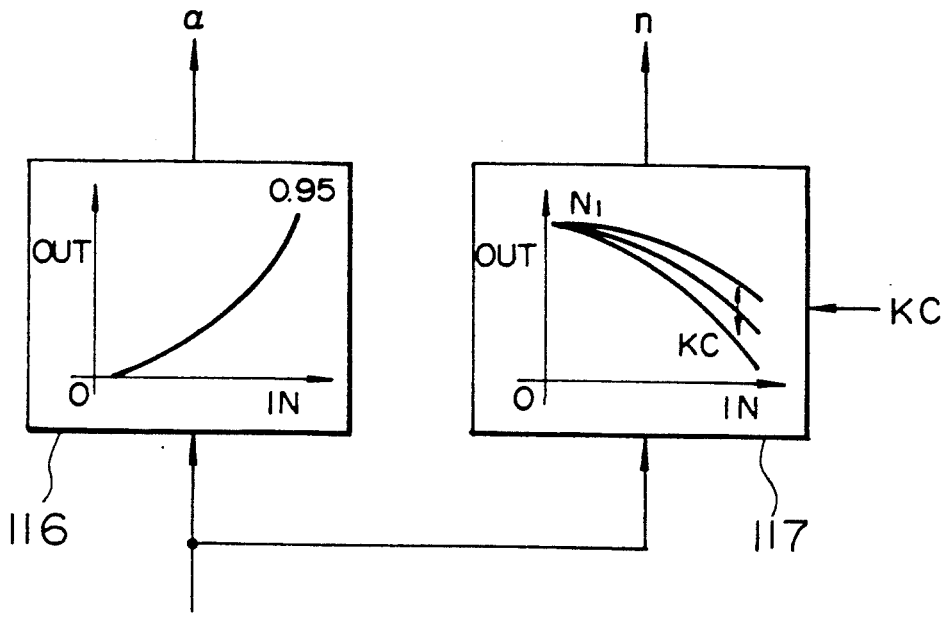
FIG. 17 is diagram showing conversion tables.

In the pitch envelope in FIG. 16, an output decreasing linearly is generated. In order to change this to the form of U as shown in the waveform in the right side of FIG. 14, conversion tables as shown in FIG. 17 can be used. The conversion tables 116 and 117 receive the output of the counter 114 shown in FIG. 16 and generate a factor $\alpha$ having U-shaped characteristic and a factor n having reversed-U-shaped characteristic.

In the case of FIG. 16, tables having a time axis reverse to that of the tables in FIG. 12 are provided because the down counter is used. The reason why theories in FIGS. 16 and 17 are reversed with respect to the time axis is as follows. It is considered that the output values of these tables may become zero correspondingly to the output of the comparator. In this case, the aforementioned tables are required for outputting standard values. The table 117 for the number of delay stages is arranged so that some curves can be selected from the key code KC.

Figure 18:
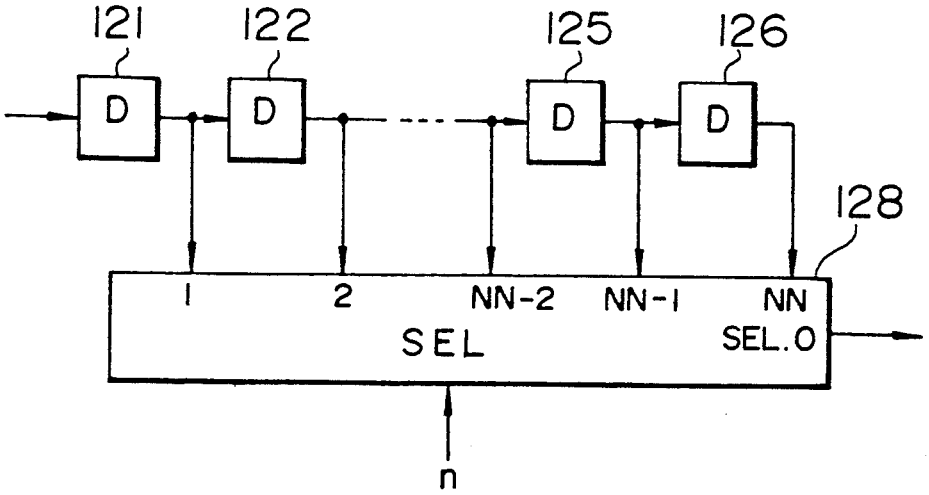
FIG. 18 is a block diagram showing an example of the configuration of the delay circuit.

FIG. 18 shows an example of the configuration of the delay circuit 23 of FIG. 2. A plurality of delay circuits 121, 122, . . . , 126 are connected in series, so that the respective outputs thereof are supplied to a selector circuit 128. The selector circuit 128 supplies an output for a predetermined number of delay stages correspondingly to the selective input. Thus, there is formed a delay circuit variable in the number of delay stages.

The circuit of FIG. 2 or a circuit equivalent to the circuit of FIG. 2 can be formed by using constituent members as described above.

In order to realize the non-harmonic just after the key on, it is important that the phase of the all-pass filter 25 is changed so as to depend on the frequency. Although the loop circuit of FIG. 2 contains the delay circuit 23, the low-pass filter 24 and the all-pass filter 25, the low-pass filter 24 is not always necessary.

Figure 19:
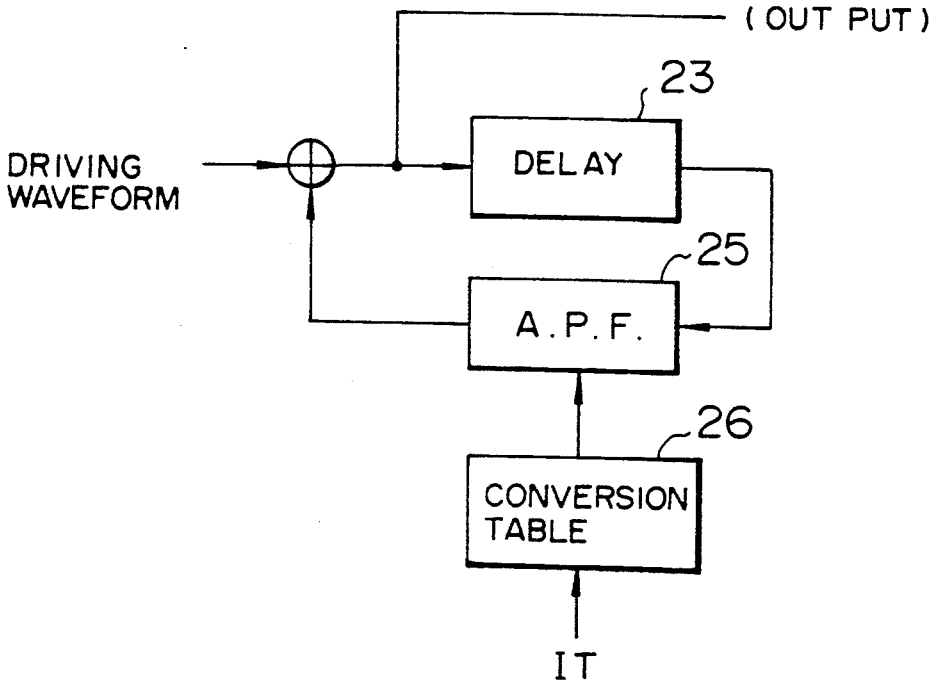
FIG. 19 is a block diagram showing an example of a loop circuit constituted by a delay circuit and an all-pass filter.

FIG. 19 shows an example of a loop circuit constituted by a delay circuit 23 and an all-pass filter 25. The change after the key on can be realized by such a circuit.

As described above, a musical tone closely resembling that of a natural musical instrument can be controlled by providing an all-pass filter in a delayed feedback loop and, in particular, controlling non-harmonic components on the basis of touch information.

It is to be understood that the invention is not limited to the aforementioned embodiments and that changes thereof may be made suitably.

Although, for example, the aforementioned embodiments have shown the case where the pitch is modulated by changing the factor of the all-pass filter corresponding to the touch, the change of frequency in a larger range can be obtained by changing the delay time of the delay circuit corresponding to the touch.

The objects of the invention can be attained not only by software using CPU but by hardware.

Although the above description has been made upon the case where a linear all-pass filter is used, the invention can be applied to the case where a multi-dimensional all-pass filter is used.

Although description has been made on limited number of embodiments, the preset invention is not limited thereto. It will be apparent for those skilled in the art that various changes, substitutions, alterations, improvements and combinations are possible within the spirit of the appeared claims.

What is claimed is:

1. A tone signal synthesizer comprising:

touch signal generation means for generating a touch signal representing a degree of a performance;

a loop circuit for circulating a tone signal;

means for applying a driving waveform to said loop circuit;

variable delay means, connected within said loop circuit, for delaying the circulating tone signal by a delay time which corresponds to the pitch of a tone signal to be synthesized;

a variable all-pass filter connected within said loop circuit and being capable of changing the phase of the tone signal corresponding to the frequency thereof;

factor generation means for generating a filtering amplification factor having a value which initially corresponds to said touch signal and which changes over time to a predetermined value; and means for applying said filtering amplification factor to said all-pass filter to variably control the phase changes imparted to the tone signal by the filter.

2. A tone signal synthesizer according to claim 1, wherein the touch signal generation means includes:

a performance manipulator for giving a performance;

touch signal forming means for forming a touch signal on the basis of performance information given by said performance manipulator; and means for supplying said touch signal to said factor generation means.

3. A tone signal synthesizer according to claim 2, in which: said performance manipulator has a large number of keys, and said touch signal forming means includes means for detecting the speed of key depression.

4. A tone signal synthesizer according to claim 2, in which: said performance manipulator includes a mouthpiece applied to a mouth and for giving out breath there through, and said touch signal forming means includes a pressure sensor for detecting the pressure of the breath.

5. A tone signal synthesizer according to claim 2, in which: said performance manipulator includes a vibrating member, and said touch signal forming means includes means for forming an envelope of vibration generated on the vibration member and for detecting a change of the envelope.

6. A tone signal synthesizer according to claim 1, in which said all-pass filter includes: a delay element for delaying an input signal; a first amplifier for amplifying the input signal with an amplification factor $\alpha$; a first adder for adding the amplified input signal to the output of said delay element in reversed phase; a second amplifier for amplifying the output of said first adder with the amplification factor $\alpha$; and a second adder for adding the output of said second amplifier to the input signal in phase at the input side of said delay element, the delay time of said delay element and the amplification factor $\alpha$ of the first and second amplifiers being controlled on the basis of an externally applied control signal.

7. A tone signal synthesizer comprising:

touch signal generation means for generating a touch signal representing a degree of a performance;

a loop circuit for circulating a tone signal;

means for applying a driving waveform based on said pitch signal to said loop circuit;

a delay circuit connected within said loop circuit, for delaying the circulating tone signal by a delay time which corresponds to the pitch of a tone signal to be synthesized;

a variable all-pass filter connected within said loop circuit and being capable of changing the phase of the tone signal corresponding to the frequency thereof;

factor generation means for generating a filtering amplification factor which changes with the passage of time and corresponding to said touch signal; and means for applying said filtering amplification factor to said all-pass filter to variably control the phase changes imparted to the tone signal by the filter, wherein said factor generation means includes means for generating a pitch envelope for controlling the filter for increasing pitch by a quantity corresponding to the touch signal simultaneously with the starting of performance manipulation and then decreasing the pitch in the form of an exponential function, said filtering amplification factor being based upon said pitch envelope, whereby both phase changes imparted to the filter and pitch changes are controlled on the basis of the pitch envelope.

8. A tone signal synthesizer according to claim 7, in which said factor generation means controls the decay of the pitch envelope correspondingly to pitch.

9. A tone signal synthesizer comprising:

touch signal generation means for generating a touch signal representing a degree of a performance;

a loop circuit for circulating a tone signal;

means for applying a driving waveform based on said pitch signal to said loop circuit;

a delay circuit connected within said loop circuit, for delaying the circulating tone signal by a delay time which corresponds to the pitch of a tone signal to be synthesized;

a variable all-pass filter connected within said loop circuit and being capable of changing the phase of the tone signal corresponding to the frequency thereof, the all-pass filter including a delay element for delaying an input signal; a first amplifier for amplifying the input signal with an amplification factor $\alpha$; a first adder for adding the amplified input signal to the output of said delay element in reversed phase; a second amplifier for amplifying the output of said first adder with amplification factor $\alpha$; and a second adder for adding the output of said second amplifier to the input signal in phase at the input side of said delay element, the delay time of said delay element and the amplification factor $\alpha$ of the first and second amplifiers being controlled on the basis of an externally applied control signal;

a factor generation means for generating a filtering amplification factor which changes with the passage of time and corresponding to said touch signal;

means for applying said filtering amplification factor to said all-pass filter to variably control the phase changes imparted to the tone signal by the filter; and means for receiving a signal representing pitch and a signal representing touch and for supplying to said all-pass filter a signal for controlling the amplification factor $\alpha$ and the delay time.

10. A tone signal synthesizer for an electronic musical instrument comprising:

loop means for circulating a tone signal;

applying means for applying a driving signal to the loop means;

variable delay means connected within the loop means, for delaying the circulating tone signal for a delay time corresponding to a tone pitch of a tone signal to be generated;

variable all-pass filter means connected within the loop means, for changing the phase of the circulating tone signal corresponding to the frequency thereof according to an all-pass filter characteristic, said variable all-pass filter means including a variable delay element for delaying the circulating tone signal and an amplifier for amplifying the circulating tone signal;

touch signal generation means for generating a touch signal representing a degree of a performance; and control means for changing a delay time of said variable delay element and an amplification factor of said amplifier in response to the touch signal so as to change the all-pass filter characteristic with the passage of time.

11. A tone signal synthesizer for an electronic musical instrument according to claim 10, wherein the all-pass filter means changes the phase of the circulating tone signal with a lapse of time in response to the touch signal.

12. A tone signal synthesizer for an electronic musical instrument according to claim 10, wherein the touch signal generation means includes a performance manipulation means for providing a performance signal, and a touch signal forming means for forming a touch signal on the basis of a degree of the performance.

13. A tone signal synthesizer for an electronic musical instrument comprising:

loop means for circulating a tone signal;

applying means for applying a driving signal to the loop means;

delay means connected within the loop means, for delaying the circulating tone signal for a delay time corresponding to a tone pitch of a tone signal to be generated;

all-pass filter means connected within the loop means, for changing the phase of the circulating tone signal corresponding to the frequency thereof according to an all-pass filter characteristic;

touch signal generation means for generating a touch signal representing a degree of a performance; and control means for controlling the all-pass filter characteristic in response to the touch signal, wherein the all-pass filter means includes a delay and wherein the delay length changes with a lapse of time in response to the touch signal to vary the pitch of the tone being generated.

* * * * *